US008061675B2

(12) United States Patent
Downey

(10) Patent No.: US 8,061,675 B2
(45) Date of Patent: Nov. 22, 2011

(54) VEHICLE SEAT ROTATION APPARATUS

(75) Inventor: Kevin Downey, Grand Rapids, MI (US)

(73) Assignee: Brunswick Corporation, Lake Forest, IL (US)

( * ) Notice: Subject to any disclaimer, the term of this patent is extended or adjusted under 35 U.S.C. 154(b) by 456 days.

(21) Appl. No.: 11/837,344

(22) Filed: Aug. 10, 2007

(65) Prior Publication Data

US 2009/0039691 A1 Feb. 12, 2009

(51) Int. Cl.
*A47C 3/18* (2006.01)

(52) U.S. Cl. ..... 248/415; 248/125.7; 248/131; 297/344.21

(58) Field of Classification Search ..... 248/125.7, 248/131, 415, 425; 297/344.21, 344.22, 297/344.23, 344.24
See application file for complete search history.

(56) References Cited

U.S. PATENT DOCUMENTS

| | | | | |
|---|---|---|---|---|
| 723,465 | A * | 3/1903 | Hornung, Jr. | 297/344.22 |
| 3,848,921 | A | 11/1974 | Rhodes | |
| 4,588,226 | A * | 5/1986 | Young et al. | 297/344.24 |
| 5,882,076 | A * | 3/1999 | Garelick et al. | 297/344.18 |
| 6,022,077 | A | 2/2000 | Kirkland et al. | |
| 6,082,680 | A | 7/2000 | Woodward et al. | |
| 6,116,183 | A * | 9/2000 | Crow et al. | 114/363 |
| 6,279,864 | B1 * | 8/2001 | Carnahan et al. | 248/418 |
| 6,325,456 | B1 * | 12/2001 | Carnahan | 297/344.24 |
| 6,877,811 | B1 * | 4/2005 | Garelick | 297/344.22 |
| 2001/0013717 | A1 | 8/2001 | Bowers et al. | |
| 2001/0015400 | A1 * | 8/2001 | Langham | 248/425 |

* cited by examiner

*Primary Examiner* — Terrell McKinnon
*Assistant Examiner* — Steven Marsh
(74) *Attorney, Agent, or Firm* — Hanley, Flight & Zimmerman, LLC

(57) ABSTRACT

A rotatable seat mount apparatus is disclosed. A disclosed apparatus includes a seat mount having a locking arm pivotally mounted within the seat mount. A lever is rotatably coupled to the locking arm so that rotation of the lever causes the locking arm to pivot from a first position in which the seat mount is prevented from rotating and to a second position in which the seat mount is enabled to rotate.

28 Claims, 5 Drawing Sheets

VEHICLE SEAT ROTATION APPARATUS

FIELD OF THE DISCLOSURE

The present disclosure relates generally to vehicle seats and, more particularly, to a vehicle seat rotation apparatus.

BACKGROUND

Many vehicle seats such as those used in boats include a swiveling or rotatable seat mount coupled to a post and base assembly (e.g., a pedestal) that is attached to a floor or deck of the boat. A swiveling or rotatable vehicle seat mount enables a seat occupant to rotate the seat to a desired position, which typically occurs when the vehicle is relatively stationary, to enable, for example, an operator of the vehicle (e.g., a driver) to adjust the position of the seat for use of vehicle controls, comfort, safety, fishing, etc.

Many boats have a swiveling or a rotatable seat mounted on a pedestal or base extending from a floor or deck and use a relatively complex lever mechanism to adjust the rotational position of the seat relative to the base or pedestal. Typically, a seat occupant must operate a lever to rotate the seat to a desired position. Releasing the lever at the desired rotational position engages a locking member and prevents further rotation of the seat. In some known mechanisms, the locking member is springably biased toward the locked condition when the locking member is disengaged to enable rotation of the seat relative to the pedestal and/or frame. In this manner, a seat occupant can operate a lever to disengage the locking mechanism and rotate the seat to a certain position at which the locking member is springably returned to the locked condition, thereby preventing rotation of the seat until the seat occupant disengages the locking member (e.g., by again operating the lever).

The above described configurations prevent a boat seat occupant or other person from freely rotating the seat. Furthermore, the above described configurations may require a boater to have an additional fishing seat. For example, a seat with a positive lock (e.g., a springably biased locking mechanism) such as those described above may be required when a boat is traveling. However, another seat that freely rotates may be preferred when the boat is stationary and the seat occupant or other person is fishing.

DETAILED DESCRIPTION

In general, the example rotational seat mount apparatus described herein provides an unlocked condition in which a vehicle seat can rotate, for example, about an axis of rotation (e.g., the longitudinal axis of a pedestal or base) by an occupant of the seat or other person, and a locked condition in which the vehicle seat is fixed (i.e., substantially immovable) about the axis of rotation. More specifically, the example seat mount rotational apparatus can be locked and unlocked by either rotating or lifting a lever.

Figure 1A:
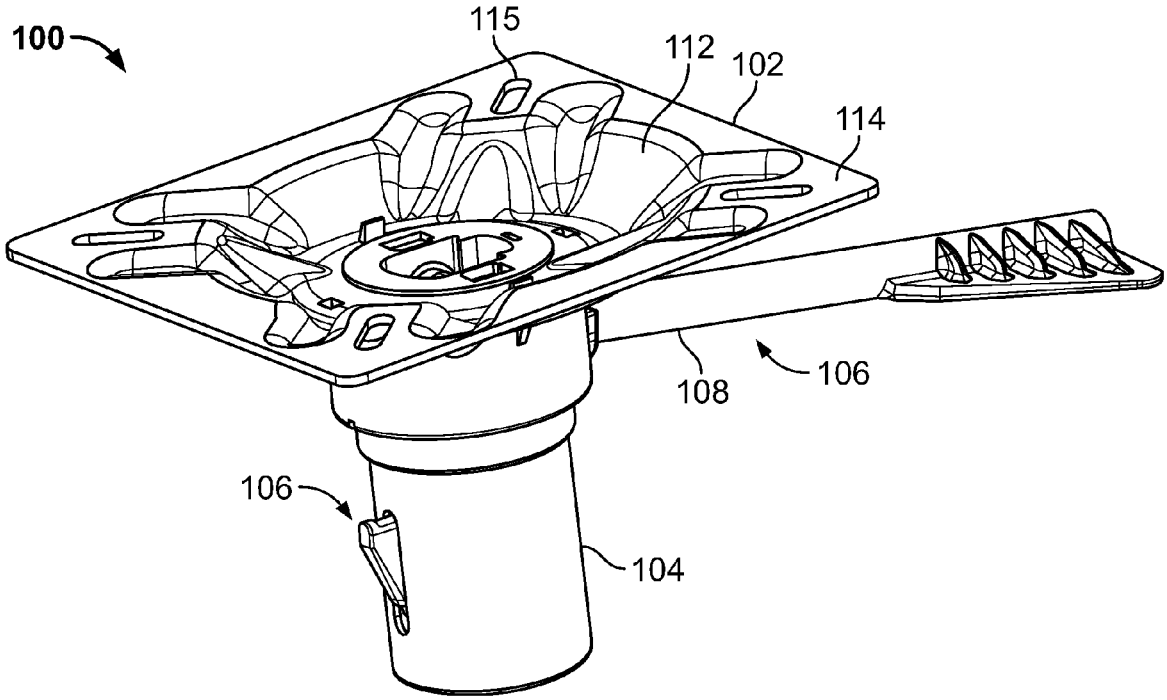
FIG. 1A depicts an example rotational seat mount assembly.

FIG. 1A illustrates an example seat mount rotational apparatus 100. The example seat mount rotational apparatus 100 includes a seat mount 102 that is configured to receive and support a vehicle seat (not shown). A sleeve 104 rotatably and removably mounts or couples the seat mount 102 to a base and/or pedestal (not shown) which, in turn, can be coupled or fixed to a floor surface of a vehicle such as, for example a boat. A locking mechanism 106 enables and prevents rotation of the seat mount 102 relative to the base and/or pedestal. The locking mechanism 106 includes a lever 108 that is operatively coupled to a latch or locking arm 110 (FIG. 1B).

FIG. 1A shows the locking mechanism 106 in a locked position, which prevents the seat mount 102 and, thus, any seat mounted thereto to be rotated relative to a base and/or pedestal. In one mode of operation, the locking mechanism 106 is unlocked by rotating the lever 108. In particular, a seat occupant or other person can rotate the lever 108 to a position that pivots the locking arm 110 (FIG. 1B) to an unlocked condition. In this mode of operation, the locking arm 110 (FIG. 1B) is held in the unlocked condition (e.g., by a cam) and enables the seat mount 102 to rotate freely relative to a base or pedestal. To lock the locking mechanism 106, the lever 108 is rotated to another position that causes the locking arm 110 to pivot to the locked condition and prevent rotation of the seat mount 102 relative to a base or pedestal. In another mode of operation, the locking mechanism 106 is unlocked by lifting the lever 108. In this unlocked condition (i.e., lifting the lever 108), the locking arm 110 is springably biased (e.g., using a spring or other resilient member) to return the locking arm 110 to the locked condition in the absence of a force being applied to the lever 108 (e.g., when the lever is released) by a seat occupant or other person.

The seat mount 102 includes a concave body 112 having a flanged edge 114. The flanged edge 114 includes mounting holes 115 for mounting a seat to the seat mount 102. A seat can be mounted to the seat mount 102 via screws or any other suitable fastening mechanism that passes into and/or through the mounting holes 115. The seat mount 102 can be made from various materials such as aluminum, steel, plastic, or any other suitable material and via any process(es) such as, for example, stamping and/or punching operations.

Figure 1B:
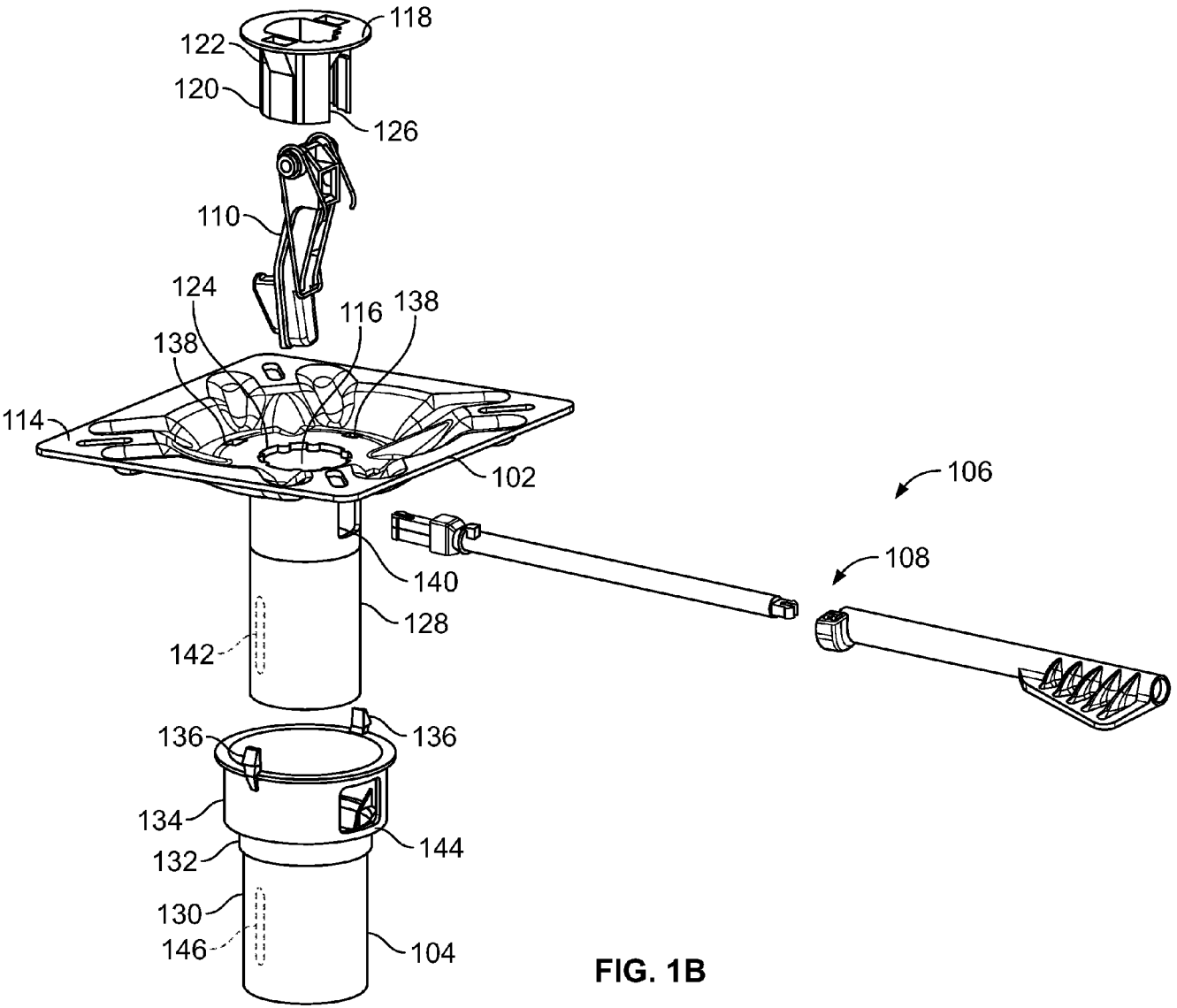
FIG. 1B is an exploded view of the example rotational seat mount assembly of FIG. 1A.

FIG. 1B is an exploded assembly view of the example seat mount rotational apparatus 100 of FIG. 1A. The seat mount 102 has a hole or aperture 116 located substantially near its center and sized to receive a cap 118. The cap 118 has elongated sides 120 to pivotally mount the locking arm 110 and includes clips or slanted tabs 122 extending from the outer surface of the elongated sides 120 and toward the top of the cap 118. The cap 118 mounts to the seat mount 102 by press and snap fitting the slanted tabs 122 in openings or slotted portions 124. The elongated sides 120 are partially separated by an opening 126 so that the locking arm 110 can pivot between the elongated sides 120.

As illustrated in FIG. 1B, a tubular member 128 extends from the seat mount 102 for insertion into the sleeve 104. In other example implementations, the tubular member 128 can be any length suitable for insertion into a pedestal and/or a base (not shown) for rotatably and/or removably mounting the seat mount 102 relative to the pedestal or base. In the illustrated example, the tubular member 128 is welded to the seat mount 102. However, in other example implementations, the tubular member 128 can be fastened or coupled to the seat mount 102 using, for example, mechanical fasteners, staking, crimping, etc. In yet other example implementations, the tubular member 128 can be integrally formed (e.g., via injection molding) with the seat mount 102 to produce a substantially unitary or single structure.

In the illustrated example, the sleeve 104 is sized to receive the tubular member 128. As discussed above, the sleeve 104 may couple the seat mount 102 to a pedestal or a base so that the seat mount 102 can rotate relative to the pedestal or base. Additionally or alternatively, the sleeve 104 may be removably mounted to the pedestal or base so that a seat occupant or other user can remove the seat mount assembly 100 from the pedestal or base.

The sleeve 104 can be a hollow cylindrically-shaped member and, as illustrated in the example, can have a stepped cylindrical shape with an elongated lower cylindrical section 130 having a diameter sized to fit within a pedestal and/or base, a middle cylindrical section 132 having a diameter larger than the lower cylindrical section 130, and an upper cylindrical section 134 having a diameter larger than the middle cylindrical section 132. A plurality of clips 136 may be used to fasten or couple the sleeve 104 to the seat mount 102. As illustrated by way of example in FIG. 1B, the plurality of holes 138 can be 90 degrees apart. As most clearly shown in FIG. 3, the clips 136 snap fitted in a pair of holes 138 on the seat mount 102 that are 180 degrees apart from a second pair of holes 138 and are sized and positioned to receive the clips 136. In other example implementations, the sleeve 104 can be fastened to the seat mount 102 and/or tubular member 128 using, for example, mechanical fasteners, welding, etc. In the illustrated example, the sleeve 104 is made of plastic. However, in other example implementations, the sleeve 104 can be made of aluminum, steel, or any other suitable material. The inner surface of the sleeve 104 may also include a plurality of vertical ribs 139 (FIG. 3) to improve the stiffness and strength of the sleeve 104.

The sleeve 104 and the tubular member 128 may include a plurality of respective openings and/or slots along their curved outer surfaces. In particular, the tubular member 128 has a first opening or slot 140 near its upper end and a second opening or slot 142 near its lower end. The slots 140 and 142 are located on opposite sides of the tubular member 128 relative to one another and the longitudinal axis of the tubular member 128. The sleeve 104 also has a first slot 144 near its upper end and a second opening or slot 146 near its lower end that are located on opposite sides of the sleeve 104 relative to each other and the longitudinal axis of the sleeve 104. The openings or slots 144 and 146 of the sleeve 104 are positioned to be aligned and in communication with the slots 140 and 142, respectively, of the tubular member 128.

Figure 2:
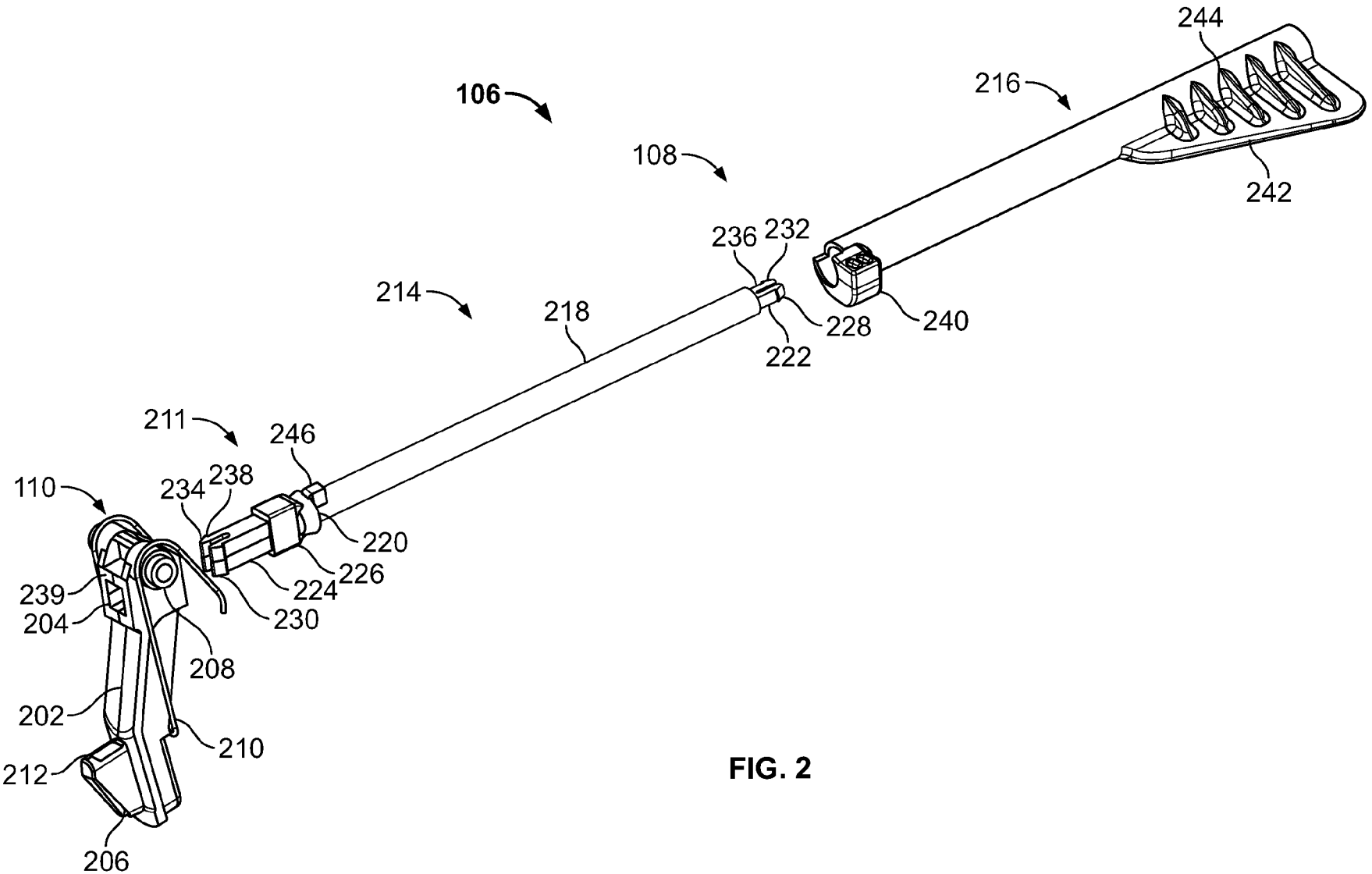
FIG. 2 is an exploded view of the example locking arm, lever and handle of FIGS. 1A and 1B.

FIG. 2 illustrates an exploded view of the example locking mechanism assembly 106 that can be used with the rotational seat mount assembly 100 shown in FIG. 1A. As illustrated in FIG. 2, the locking arm 110 includes a body 202 having an opening or cavity 204, a protrusion or locking tab 206, a cylindrical pin 208, and a biasing element 210. The cavity 204 is sized to receive an end 211 of the lever 108 and is substantially aligned with the openings or slots 140 and 144 (FIG. 1B). Additionally, the protrusion or locking tab 206 is substantially aligned with the openings or slots 142 and 146 (FIG. 1B).

The locking tab 206 is sized and configured to pass through the slots 142 and 146 and to engage a respective opening or groove (not shown) in a base and/or pedestal to rotatably lock the seat mount 102 and, thus, to prevent any seat mounted thereto from rotating relative to the base and/or pedestal. The locking tab 206 may include a protruding edge 212 that can engage the opening or groove (not shown) in the base when the locking arm 108 is in the locked condition to prevent the locking arm 108 as well as the sleeve 104 and the tubular member 128, which are penetrated by the locking tab 206 via the slots 142 and 146, from pivoting away from a desired locked condition (i.e., moving to the unlocked condition absent a seat occupant or other user rotating or lifting the lever 108). Additionally or alternatively, the base or an insert (not shown), which is inserted in the base, can include a plurality of openings or grooves in which the locking tab 206 may engage to lock the seat mount 102 at various rotational or angular positions relative to, for example, a forward facing orientation.

In the example, the locking tab 206 is made of aluminum and is over molded with the locking arm body 202, which is made of plastic. In other example implementations, the locking tab 206 can be coupled or fastened to the locking arm body 202 by using, for example, mechanical fasteners, welding, etc. In yet other example implementations, the locking arm body 202, the locking tab 206, the cylindrical pin 208 and the protruding edge 212 can be integrally formed (e.g., via injection molding) to produce a substantially unitary or single structure and can be made of any material such as, plastic, steel, aluminum, or any other suitable material or combination of materials.

The illustrated example depicts the lever 108 having a stem 214 portion and a handle 216 portion. The stem 214 can include a cylindrically-shaped body 218 having a coupling 220 adjacent a first end of the stem body 218 and a U-shaped clip 222 adjacent a second end of the stem body 218. The coupling 220 couples the body 218 to a U-shaped clip 224 having a stop 226. The U-shaped clips 222 and 224 have respective tabs 228 and 230 that flare outwardly at the ends of the clips 222 and 224. The tabs 228 and 230 have respective angled front surfaces 232 and 234 and horizontal side surfaces 236 and 238. In the example illustration, the stem 214 can be integrally formed via injection molding to produce a substantially unitary or single piece structure.

The stem 214 is operatively coupled to the locking arm 110 via snap fitting the clip 224 in the cavity 204. The stop 226 has a height and length sized larger than the cavity 204, and the clip 224 can be progressively tapered and sized so that the clip 224 can be press and snap fitted in the cavity 204 so that the side 238 of the tabs 234 are in contact with a surface 239 of the locking arm body 202, and the stop 226 is in contact with the surface of the locking arm body 202 opposite the surface 239. In other example implementations, the locking arm 110 can be coupled to the lever 108 via mechanical fasteners or any other suitable fastening mechanism(s). In yet other example implementations, the lever 108 can be integrally formed (e.g., via injection molding) with the locking arm 110 to produce a substantially unitary or single piece structure.

The handle portion 216 of the lever 108 is a hollow cylindrical member that slidably engages the stem body 218. The handle 216 has a curved surface or cam-shaped member 240 at one of its ends and a grip 242 at its other end. The grip 242 includes a flat surface having a plurality of raised portions or ribs 244 along its surface that can aid a seat occupant or other person to firmly grip the handle 216 portion of the lever 108. The handle 216 can have an interior surface (not shown) that is progressively tapered from the curved surface or cam-shaped member 240 to the grip 242. In the illustrated example, the interior surface of the handle 216 may have a recessed lip (not shown) adjacent the grip 242 of the handle 216 that is sized and positioned to receive the clip 222. The clip 222 is snap fitted into the recessed lip (not shown) of the handle 216 to form the lever 108 and to rotatably couple the handle 216 to the stem 214. In other example implementations, the stem 214 and the handle 216 are rotatably coupled via mechanical fasteners or any other suitable fastening mechanism(s). As shown, a stop 246 may protrude from the stem body 218 to prevent the handle 216 from rotating beyond the rotational position required to pivot the locking arm 110 from the locked condition to the unlocked condition.

In the illustrated example, the handle 216 and the stem 214 are plastic. However, in other example implementations, the handle 216 and the stem 214 can be made of aluminum, steel, or any other suitable material. Alternatively, in other example implementations, the stem 214 can be integrally formed (e.g., via injection molding) with the handle 216 to produce a unitary or single piece structure.

The curved surface or cam-shaped member 240 of the lever 108 can be a cam. However, in other example implementations, the curved surface or cam-shaped member 240 can have other shapes, for example, elliptical, circular, etc., or any other suitable member having a curve-shaped surface to cause the latch or locking arm 110 to move from a first position (i.e., locked condition) to a second position (i.e., unlocked condition).

Figure 3:
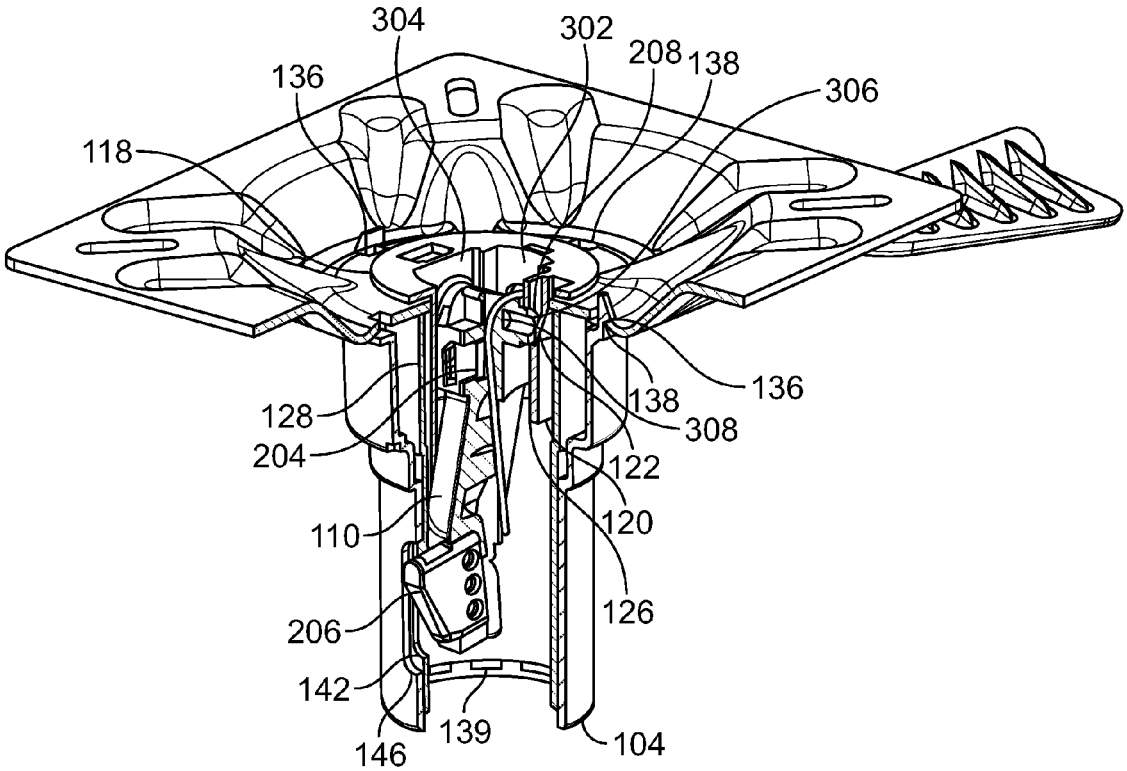
FIG. 3 is a cross-sectional view of the example rotational seat mount assembly of FIG. 1A.

As most clearly shown in FIG. 3, the cap 118 pivotally mounts and couples the locking arm 110 within the tubular member 128. The cylindrical pin 208 pivotally mounts the locking arm 110 to the elongated sides 120 of the cap 118. An interior surface 302 of the elongated sides 120 of the cap 118 have recessed tracks 304 and recessed apertures 306 to allow the cylindrical pin 208 to slide therein and snap fit into the recessed apertures 306, thereby creating a pivot point 308 so that the locking arm 110 can pivot relative to the longitudinal axis of the cylindrical pin 208. The elongated sides 120 are partially separated by the opening 126 so that the locking arm 110 can pivot between the elongated sides 120. In other example implementations, the cylindrical pin 208 can be fastened to the elongated sides 120 of the cap 118 via mechanical fasteners, clips, or any other suitable fastening mechanism(s). Although the example illustrates the locking arm 110 pivotally mounted to the cap 118, in other example implementations, the locking arm 110 can be pivotally mounted to the tubular member 128, the sleeve 104, the seat mount 102, or to the surface of the cap 118 with mechanical fasteners, or any other suitable fastening mechanism(s).

Figure 4:
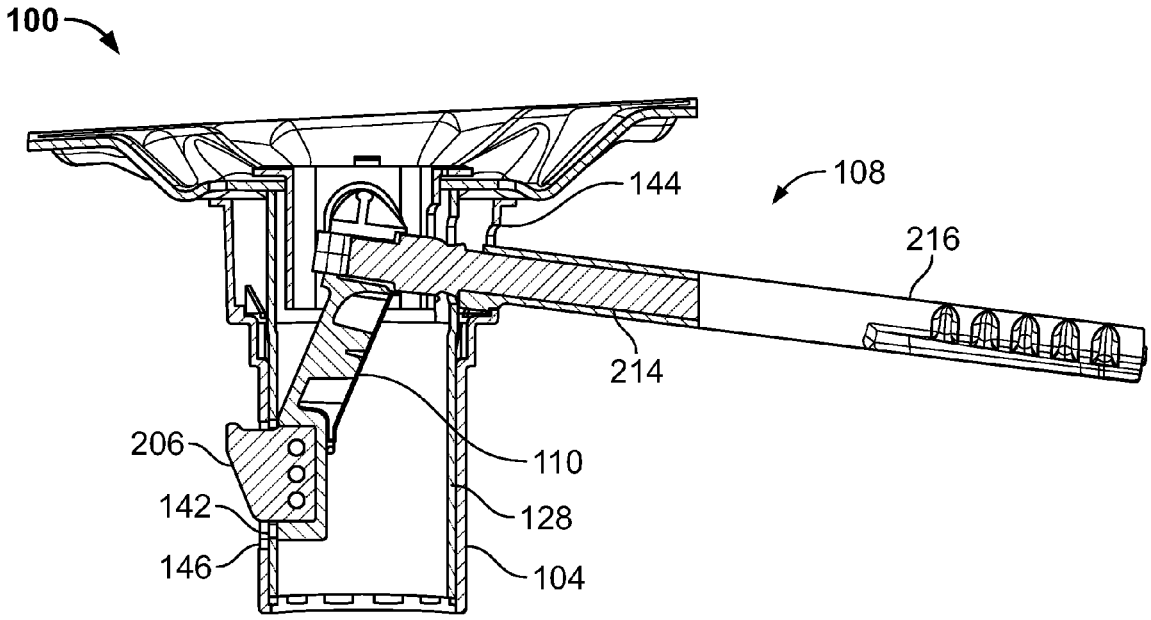
FIG. 4 is a cross-sectional side view of the example rotational seat mount assembly of FIG. 1A shown in a locked position.
Figure 5:
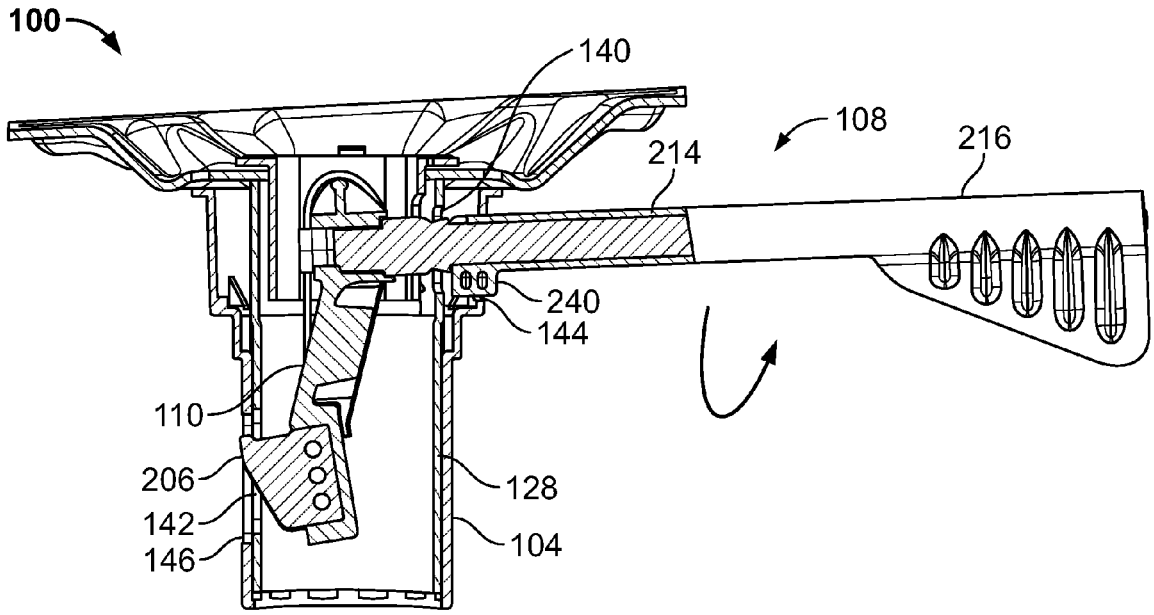
FIG. 5 is a cross-sectional side view of the example rotational seat mount assembly of FIG. 1A illustrating the seat mount in an unlocked condition by rotation of the handle.
Figure 6:
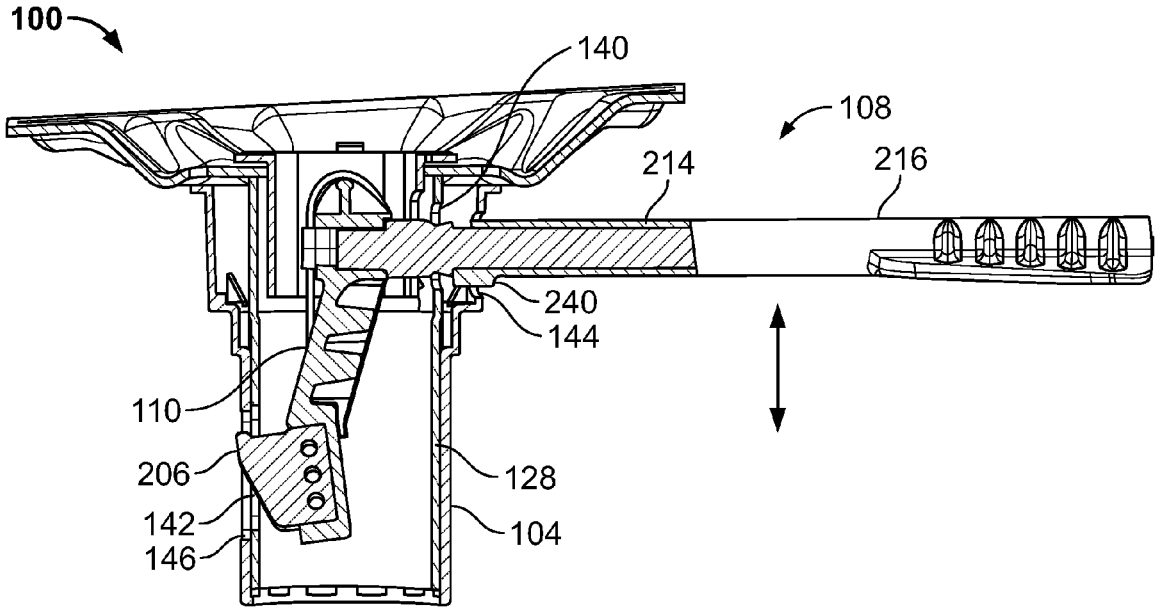
FIG. 6 is a cross-sectional side view of the example rotational seat mount assembly of FIG. 1A illustrating the seat mount in an unlocked condition by lifting the lever.

Turning to the operation of the example seat mount rotational apparatus 100, FIGS. 4-6 illustrate the example seat mount rotational apparatus 100 in the locked and unlocked conditions. FIG. 4 illustrates the example seat mount rotational apparatus 100 in the locked position. The locking tab 206 passes through the slots 146 and 142 of the sleeve 104 and the tubular member 128, respectively, and engages an opening or groove of a base or pedestal, thereby preventing rotation of the seat mount rotational apparatus 100.

FIG. 5 illustrates the example seat mount rotational apparatus 100 in the unlocked condition by rotating the handle 216. To unlock the seat mount rotational apparatus 100, the seat operator or other person rotates the handle 216 from the locked position shown in FIG. 4. The curved surface or cam-shaped member 240 of the handle 216 rotates against the edge of slot 144 of the sleeve 104 and causes the lever 108 to lift which, in turn, causes the locking arm 110 to pivot from the locked condition to the unlocked condition (i.e., the seat mount 102 can rotate relative to a base or pedestal). The handle 216 and, thus, the curved surface or cam-shaped member 240 are rotated until the curved surface or cam-shaped member 240 engages the stop 246 of the lever 108. The curved surface or cam-shaped member 240 causes the locking arm 110 to remain in the unlocked condition until the seat operator or other person rotates the handle 216 back to the position shown in FIG. 4. As the handle 216 is rotated back to the position as shown in FIG. 4, the curved surface or cam-shaped member 240 rotates away from the edge of the slot 144 causing the lever 108 to pivot the locking arm 110 to the locked condition.

FIG. 6 illustrates the locking arm 110 in the unlocked condition by lifting the lever 108. In this manner, the locking arm 110 is biased in the locked condition by the biasing element 210 (e.g., a spring) that is operatively coupled to the locking arm 110. To unlock the seat mount rotational apparatus 100 as shown in FIG. 6, the seat operator or other person lifts the lever 108 from the locked position shown in FIG. 4. The lifting force applied to the lever 108 causes the locking arm 110 to pivot to the unlocked condition. To return the locking arm 110 to the locked condition, the seat operator or other person can release the lever 108, and the biasing element 210 biases the locking arm 110 to the locked condition when the locking tab 206 passes through slots 142 and 146 and engages an opening or groove in the base and/or pedestal. Alternatively or additionally, a biasing element or spring can be operatively coupled to the lever 108 to provide a force to urge the locking arm 110 toward the locked condition.

The example seat mount rotational assembly 100 is not limited to the illustrated configuration and can be configured (e.g., sized, shaped, utilize any combination of materials, etc.) for any particular seat and/or base. For example, the curved surface (e.g., a cam) of the lever 108 can be in direct contact with the latch (e.g., the body of the locking arm) such that the curved surface or cam-shaped member 240 rides along the body of the locking arm 110 causing the locking arm to pivot from a first position (e.g., a locked condition) to a second position (e.g., an unlocked condition).

In yet other example implementations, the slots 140 and 144 and the slots 142 and 146, respectively, may be located on the same side relative to each other and the longitudinal axis of the seat mount 102 such that applying a downward force or rotating the lever 108 causes the locking arm 110 to pivot between the locked and unlocked conditions. In yet another example implementation, the slots 140 and 144 and slots 142 and 146, respectively, can be located perpendicular relative to each other so that applying force to move the lever 108 from side to side, or rotating the handle 216, causes the locking mechanism to pivot between the locked and unlocked conditions.

The illustrated example seat mount rotational apparatus 100 described herein has a self-lock or positive lock (e.g., springably biased) locking mechanism in addition to a mode of operation that allows hands free rotation of a seat relative to a base without requiring the seat occupant or other person to apply constant force to the lever. This is particularly advantageous for boat operators who are fishing and desire a hands-free rotating seat, but require a self-locking seat when the boat is traveling. Thus, the illustrated example seat mount rotational apparatus 100 eliminates the need to have two separate boat seats, one with a positive lock that may be required when the boat is traveling, and one that is free to rotate that may be desired when the boat occupant or other person is fishing.

Although certain apparatus have been described herein, the scope of coverage of this patent is not limited thereto. To the contrary, this patent covers all apparatus fairly falling within the scope of the appended claims either literally or under the doctrine of equivalents.

What is claimed is:

1. A rotatable seat mount apparatus, comprising:

a seat mount;

a locking arm pivotally mounted within the seat mount to move about a pivot axis; and a lever rotatable about a longitudinal axis of the lever that is non-parallel relative to the pivot axis of the locking arm, the lever being operatively coupled to the locking arm such that rotation of the lever about the longitudinal axis causes the locking arm to move between a first position in which the seat mount is prevented from rotating and a second position in which the seat mount is enabled to rotate.

2. An apparatus as defined in claim 1, wherein the lever comprises a cam to pivot the locking arm between the first position to the second position.

3. An apparatus as defined in claim 1, wherein the seat mount is to be rotatably coupled to a pedestal.

4. An apparatus as defined in claim 1, further comprising a tubular member extending from the seat mount, the tubular member having a first slot located at an upper end of the tubular member and a second slot located at a lower end of the tubular member.

5. An apparatus as defined in claim 4, wherein the locking arm is to be pivotally mounted within the tubular member and having a locking tab to engage the second slot.

6. An apparatus as defined in claim 4, wherein the tubular member is to be rotatably coupled to a pedestal.

7. An apparatus as defined in claim 1, wherein rotation of the lever from the first position to the second position causes the locking arm to remain in the second position, and rotation of the lever from the second position to the first position causes the locking arm to remain in the first position.

8. An apparatus as defined in claim 1, wherein the first position is associated with a locked condition in which the seat mount is prevented from rotating and the second position is associated with an unlocked condition in which the seat mount is enabled to rotate.

9. An apparatus as defined in claim 1, wherein the lever is pivotally coupled to the locking arm, and wherein the lever is urged to a third position when a lifting force is applied to the lever and urged to a fourth position when the lifting force is released from the lever.

10. An apparatus as defined in claim 9, wherein the third position is associated with an unlocked condition in which the seat mount is enabled to rotate and the fourth position is associated with a locked condition in which the seat mount is prevented from rotating.

11. An apparatus as defined in claim 9, further comprising a biasing member operatively coupled to the locking arm to bias the locking arm toward the fourth position when the lifting force is released from the lever.

12. A rotatable seat mount apparatus, comprising:

a seat mount;

a tubular member extending from the seat mount and having a first opening located at an upper end of the tubular member and a second opening located at a lower end of the tubular member;

a sleeve to receive at least a portion of the tubular member and to be rotatably coupled to a base, wherein the sleeve has a third opening located at an upper end of the sleeve and a fourth opening located at a lower end of the sleeve, wherein the first opening is to be in communication with the third opening and the second opening is to be in communication with the fourth opening;

a latch operatively mounted within the tubular member; and a lever having a curved surface adjacent a first end and a grip adjacent a second end such that rotation of the grip and the curved surface causes the latch to move between a first position in which the seat mount is prevented from rotating relative to the base and a second position in which the seat mount is enabled to rotate relative to the base.

13. An apparatus as defined in claim 12, wherein rotation of the lever from the first position to the second position causes the latch to remain in the second position, and rotation of the lever from the second position to the first position causes the latch to remain in the first position.

14. An apparatus as defined in claim 12, wherein the latch has a protrusion to engage the second and fourth openings.

15. An apparatus as defined in claim 12, wherein the latch is pivotally mounted to the lever and within the tubular member.

16. An apparatus as defined in claim 12, further comprising a cap having elongated sides, wherein the latch is pivotally mounted to the cap.

17. An apparatus as defined in claim 16, wherein the cap is mounted to the seat mount.

18. An apparatus as defined in claim 12, wherein the lever is pivotally mounted to the latch such that a lifting force applied to the lever causes the latch to pivot from the first position to the second position.

19. An apparatus as defined in claim 18, further comprising a biasing member operatively coupled to the latch to bias the latch toward the first position when the lifting force is released from the lever.

20. An apparatus as defined in claim 19, wherein the biasing member is a spring.

21. An apparatus as defined in claim 12, wherein the lever comprises a stem and a handle.

22. An apparatus as defined in claim 21, wherein the handle slidably receives the stem.

23. An apparatus as defined in claim 21, wherein the handle and the stem are operatively and rotationally coupled to the latch.

24. An apparatus as defined in claim 21, wherein rotation of the handle causes the latch to move between the first position and the second position.

25. An apparatus as defined in claim 12, wherein the sleeve is to be removably mounted to the base.

26. An apparatus as defined in claim 12, wherein an inner surface of the sleeve comprises a plurality of vertical ribs.

27. A rotatable seat mount apparatus, comprising:

a seat mount;

a locking arm pivotally mounted within the seat mount;

a lever rotatably coupled to the locking arm, wherein rotation of the lever causes the locking arm to pivot from a first position in which the seat mount is prevented from rotating and to a second position in which the seat mount is enabled to rotate; and a tubular member extending from the seat mount, the tubular member having a first slot located at an upper end of the tubular member and a second slot located at a lower end of the tubular member, wherein the locking arm is to be pivotally mounted within the tubular member and has a locking tab to engage the second slot.

28. A rotatable seat mount of claim 1, wherein the pivot axis of the locking arm is oriented in a direction that is substantially perpendicular relative to the longitudinal axis of the lever.

* * * * *